US009650192B2

(12) United States Patent
Schindler

(10) Patent No.: US 9,650,192 B2
(45) Date of Patent: May 16, 2017

(54) BOTTLE CARRIER

(71) Applicant: Zoxxbox, LLC, Miamisburg, OH (US)

(72) Inventor: Michael Schindler, Liberty Township, OH (US)

(73) Assignee: Zoxxbox, LLC, Miamisburg, OH (US)

( * ) Notice: Subject to any disclaimer, the term of this patent is extended or adjusted under 35 U.S.C. 154(b) by 0 days.

(21) Appl. No.: 15/046,430

(22) Filed: Feb. 17, 2016

(65) Prior Publication Data

US 2016/0236840 A1 Aug. 18, 2016

Related U.S. Application Data

(60) Provisional application No. 62/117,193, filed on Feb. 17, 2015.

(51) Int. Cl.
*B65D 71/54* (2006.01)

(52) U.S. Cl.
CPC .. *B65D 71/0007* (2013.01); *B65D 2571/0045* (2013.01); *B65D 2571/0066* (2013.01); *B65D 2571/00141* (2013.01); *B65D 2571/00456* (2013.01); *B65D 2571/00722* (2013.01); *B65D 2571/00919* (2013.01); *B65D 2571/00932* (2013.01)

(58) Field of Classification Search
CPC ..... B65D 71/0007; B65D 2571/0045; B65D 2571/00456; B65D 2571/0066; B65D 2571/00919; B65D 2571/00722
USPC ..... 229/117.13, 117.14; 206/170–191
See application file for complete search history.

(56) References Cited

U.S. PATENT DOCUMENTS 2,543,821 A * 3/1951 Arneson ..... B65D 71/0014 206/180
3,158,286 A * 11/1964 Phillips, Jr. ..... B65D 71/0014 206/180
4,365,738 A * 12/1982 Densen ..... B65D 5/22 206/459.5
5,069,335 A * 12/1991 Beales ..... B65D 5/427 206/144
5,221,001 A * 6/1993 Eisman ..... B65D 71/0007 206/144
6,089,638 A * 7/2000 Whitnell ..... B65D 71/0014 206/175
2003/0230499 A1* 12/2003 Wagner ..... B65D 5/4275 206/216
2011/0122212 A1* 5/2011 Pettersson ..... B31B 1/74 347/110

* cited by examiner

*Primary Examiner* — Christopher Demeree
*Assistant Examiner* — Phillip Schmidt
(74) *Attorney, Agent, or Firm* — Frost Brown Todd LLC

(57) ABSTRACT

A method of constructing a carrier for bottles (such as two or four craft beer bottles), wherein the layout fits through a digital printer, is disclosed. A flat of beverage board is printed upon (on one side or both, though all exterior surfaces are derived from one side of the board) with individualized and/or short-run graphics. The flat is die-cut and folded into a square or rectangle closed by a tab that is glued on the back of one of side panels, and bottom flaps are folded and glued into place. A riser extends up from each of a pair of opposite sides to support a handle flap, and the handle flaps are glued together across the top of the rectangle.

18 Claims, 6 Drawing Sheets

BOTTLE CARRIER

REFERENCE TO RELATED APPLICATION

This application claims priority to U.S. Provisional Application No. 62/117,193, filed Feb. 17, 2015, with title BOTTLE CARRIER, the entire disclosure of which is hereby incorporated by reference.

FIELD

The present invention relates to carriers for carrying bottles. More specifically, the present invention relates to structures and assembly of cartons for carrying bottles, the cartons being made of paper board and the like and having a handle for carrying the same.

DESCRIPTION

Figure 1:
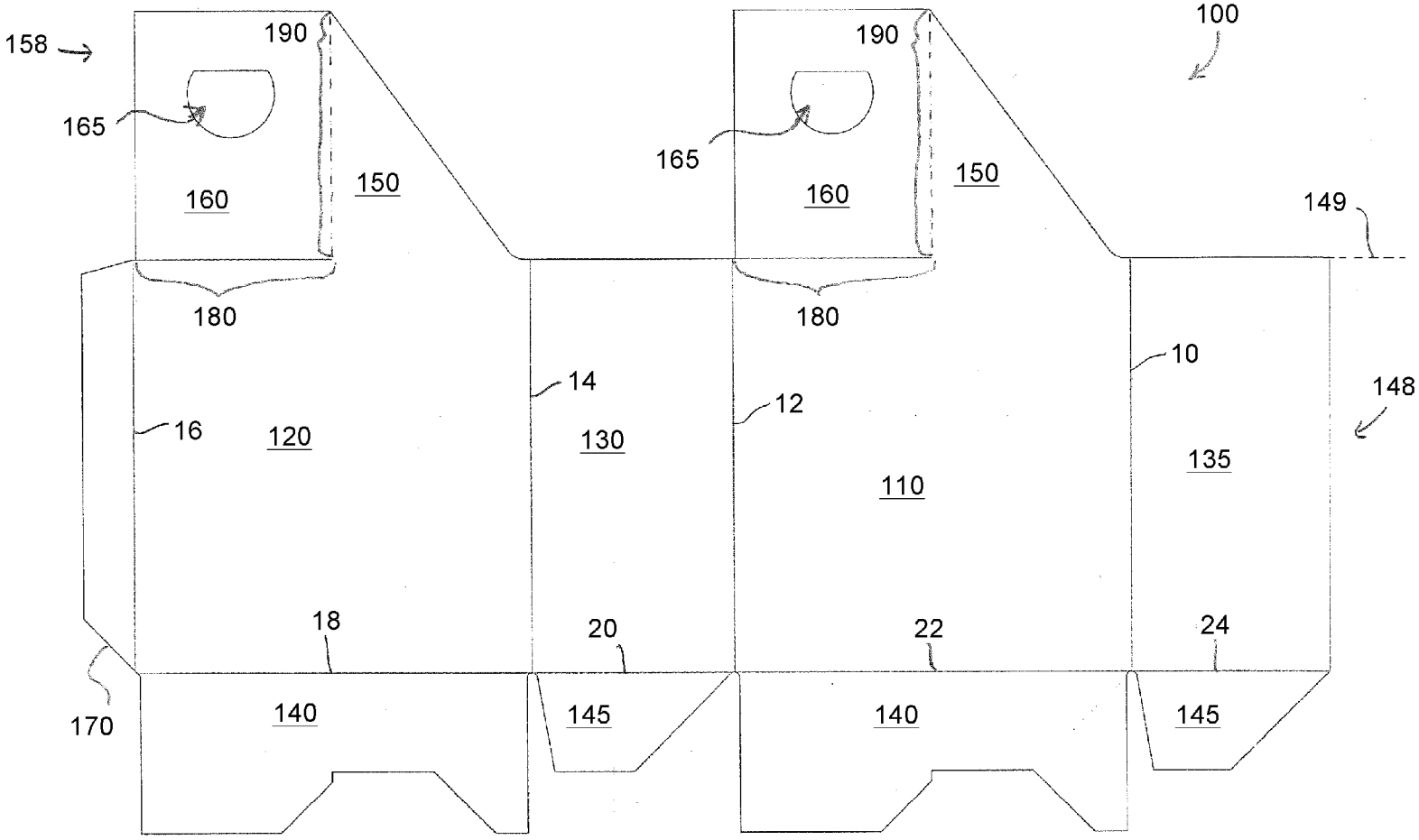
FIG. 1 is a plan view of a flat that may be formed into a bottle carrier according to a first embodiment.

For the purpose of promoting an understanding of the principles of the present invention, reference will now be made to the embodiment illustrated in the drawings and specific language will be used to describe the same. It will, nevertheless, be understood that no limitation of the scope of the invention is thereby intended; any alterations and further modifications of the described or illustrated embodiments, and any further applications of the principles of the invention as illustrated therein are contemplated as would normally occur to one skilled in the art to which the invention relates.

Generally, one form of the present apparatus is a carrier that holds two bottles, such as those used for craft beer. However, it will be understood that the carrier may be configured to hold any suitable number of bottles and/or size of bottles or other articles. This embodiment, illustrated in FIG. 1, is a flat form 100 that is die-cut from beverage board (such as that known as "20 pt board" available from most paper merchants), though other materials may also be used as will occur to those skilled in the art. FIG. 1 shows one side (e.g., a front) of flat 100, and it will be understood that the opposing side (e.g., the corresponding rear) is essentially a mirror image of the view shown. As discussed in further detail below, form 100 may be assembled or formed into an assembled configuration to form the carrier.

As shown, form 100 includes front panel 110, back panel 120, side panels 130, 135, bottom panels 140, 145, and tab 170 that collectively define a container portion 148. In the embodiment shown, panels 110, 120, 130, 135 define a top edge extending along a line 149. Form 100 further includes risers 150 and handle flaps 160 from which carrying holes 165 are fully or partially cut out, extending substantially from line 149 away from top edge, to define a handle portion

158. In alternative embodiments, portions of handle portion may extend below line 149. For example, segment 180 may extend below line 149, thus causing portions of handle flaps 160 to lie below line 149. It will be understood that in some embodiments, after form 100 is assembled into the assembled configuration, some portions of handle portion 158, such as portions of handle flaps 160, may lie below line 149, due to manufacturing or assembly-related anomalies or inconsistencies. In the embodiment shown, holes 165 are sized and configured to receive at least one finger of a person carrying the carrier in the assembled configuration.

Container portion 148 includes a plurality of fold lines 10, 12, 14, 16, 18, 20, 22, 24 along which portions of form 100 may be folded in order to form the assembled configuration of form 100. More particularly, fold line 10 extends between panels 135, 110, while fold line 12 extends between panels 110, 130. Fold line 14 extends between panels 130, 120, and fold line 16 extends between panel 160 and flap 170. Fold line 18 extends between panels 120 and the adjacent bottom panel 140, while fold line 20 extends between panel 130 and the adjacent bottom panel 145. Fold line 22 extends between panel 110 the adjacent bottom panel 140, and fold line 24 extends between panel 135 and the adjacent bottom panel 145. Fold lines 190 extend between handle flap 160 and riser 150. In the embodiment shown, fold lines 10, 12, 14, 16, 190 are parallel to one another and perpendicular to fold lines 18, 20, 22, 24. As shown, fold lines 18, 20, 22, 24 are co-linear when form 100 is unassembled. In the embodiment shown, fold lines 10, 12, 14, 16, 18, 20, 22, and 24 represent imaginary lines along which form 100 may be folded to form the carrier. However, in some embodiments, any or all of fold lines 10, 12, 14, 16, 18, 20, 22, 24 may be scored, perforated, or otherwise treated or configured in a manner that facilitates later handling or assembly of the form 100. Edges and/or fold lines shown herein as parallel or perpendicular might be substantially (but not precisely) parallel or perpendicular, or may have other relative orientations as will occur to those skilled in the art.

As form 100 is formed by a die cutting process, for example, handle edge segments 180 are also cut, separating each handle flap 160 from its respective neighboring panel 110 or 120. Moreover, in the embodiment shown, fold lines 190 are scored, perforated, or otherwise treated or configured in a manner that facilitates later handling or assembly of the form 100. However, in other embodiments, one or both of fold lines 190 may not include such features such that fold lines 190 represent imaginary lines along which flaps 160 may be folded. Moreover, in other embodiments, segments 180 and creases 190 may be treated before or after form 100 is created through a die cutting process.

After form 100 is cut, it is passed through forming equipment as is known by those skilled in the art. In this case, panels 135, 110, 130, and 120 are folded at approximately 90-degree angles to form a rectangular shape, in cross section, such as in cross section along line 149 (e.g., block 302 of FIG. 6). Tab 170 is likewise folded to be inside side panel 135 and attached with any suitable glue or other adhesive or bonding agent or non-adhesive technique such as a tab-and-slot configuration (all generically "glued" or "attached" herein) as will occur to those skilled in the art (e.g., block 304 of FIG. 6). More particularly, panel 135 is folded along fold line 10, panel 110 is folded along fold line 12, and panel 120 is folded along fold line 14, such that panels 110, 120 end up being parallel to one another and each end up perpendicular to panels 130, 135. As mentioned above, tab 170 is folded inside panel 135 and bonded thereto, such that a bonding is provided between tab 170 and panel 135 along a third plane that is substantially perpendicular to line 149 and parallel to a second plane (block 306 of FIG. 6). More specifically, in the illustrated embodiment, tab 170 is bonded to the back of panel 135. Thus, panels 110, 120, 130, 135 will remain in the substantially rectangular cross-sectional shape, due at least in part to the bonding between tab 170 and panel 135. As shown, panels 110, 120 define a length of the rectangular cross-sectional shape, and panels 130, 135 define a width of the rectangular cross-sectional shape. In the present embodiment, the length as defined by panels 110, 120 is longer than the width defined by panels 130, 135. However, other suitable relative dimensions of panels 110, 120, 130, 135 and other portions of flat 100 that may be provided in order to accommodate a particular amount and/or size of bottles or articles will be apparent to persons skilled in the art in view of the teachings herein.

In order to form the bottom portion of the expanded carrier configuration of form 100, bottom panels 140 and 145 are folded up along their respective fold lines 18, 20, 22, 24 and glued together. In the embodiment shown, in the assembled configuration, bottom panels 140, 145 lie substantially perpendicularly to each of the panels 110, 120, 130, 135. Thus, in the embodiment shown, panels 110, 120, 130, 135, 140, 145 in the assembled configuration define a single compartment extending substantially from bottom panels 140, 145 to line 149 (e.g., block 302 of FIG. 6). More particularly, panels 110, 120, 130, 135 define sidewalls of a compartment, while bottom panels 140, 145 collectively define a bottom portion or bottom wall of a compartment.

Figure 6:
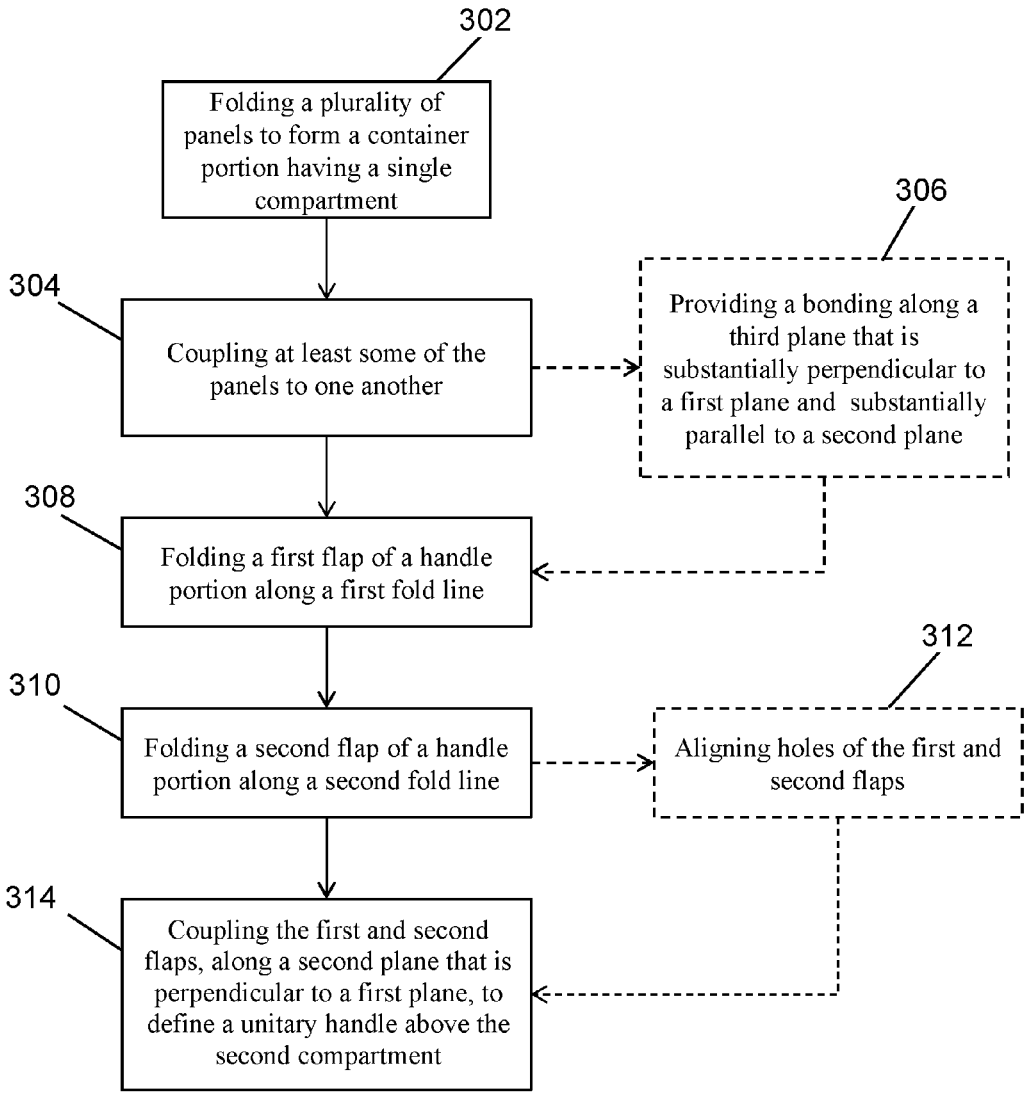
FIG. 6 is a flowchart depicting a method of forming a carrier from a flat.

Handle flaps 160 are folded at fold lines 190 so that they extend perpendicular to risers 150 and parallel to side panels 130 and 135 (blocks 308, 310 of FIG. 6). The rear portions of each of handle flaps 160 are glued together such that each of the holes 165 is aligned with the other to form a single opening in handle portion 158, and such that flaps 160 lie substantially along a second plane in order to form a unitary handle of handle portion 158 (blocks 312, 314 of FIG. 6). In the embodiment shown, the second plane essentially bisects container portion 148 such that the handle formed by handle portion 158 lies at the midpoint between panels 130, 135. Thus, in the embodiment shown, handle portion 158 essentially defines two cells above line 149 that are each suitable for holding a bottle. Accordingly, while carton portion 148 defines a single compartment as described above, handle portion 158 allows for an effective separation of bottles or other articles that may be placed in the compartment of carton portion 148.

In some implementations, before or after form 100 is cut out, form 100 may be passed through a digital printer that selectively applies text and/or graphics to one or both sides of the form 100. In some of these implementations, the text and/or graphics are customized by a third party, automatically computer-generated per a remote customer's request, programmatically and even uniquely generated, or otherwise designed to take advantage of short-run capabilities and/or digital printing technology. Because of the configuration of form 100 as described herein, text and graphics need only be applied to one side of form 100 in its flattened configuration in order to display such text and/or graphics on the surfaces of form 100 that are on the outside when form 100 is in its expanded, carrier configuration.

Figure 2:
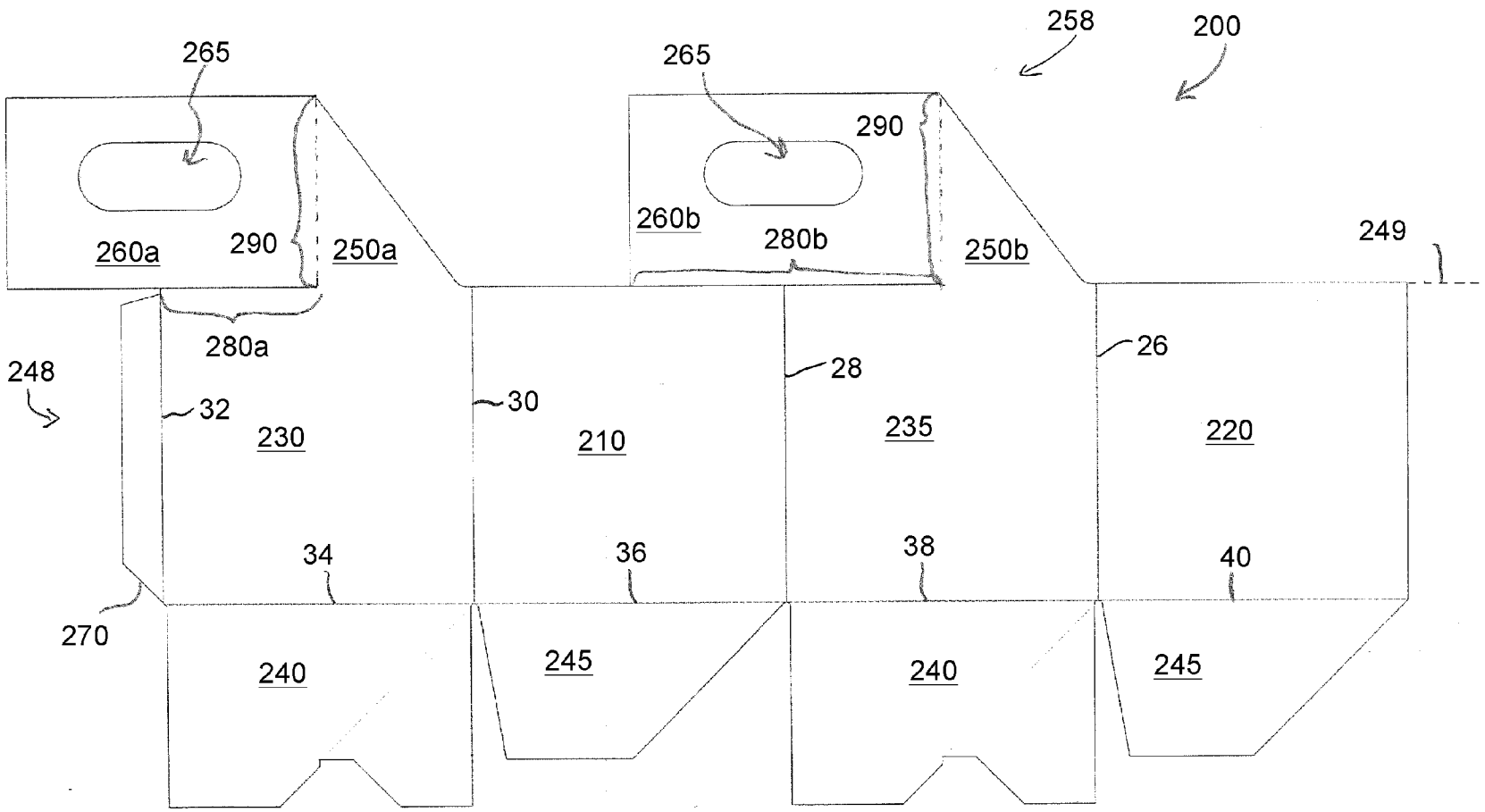
FIG. 2 is a plan view of a flat that may be formed into a carrier according to a second embodiment.

FIG. 2 shows another embodiment of a form 200 that may be constructed or formed into an assembled configuration to make a carrier configured to hold four bottles. However, it will be understood that the carrier may be configured to hold any suitable number of bottles and/or size of bottles or other articles as will occur to those having ordinary skill in the art in view this disclosure. This embodiment, illustrated in FIG. 2, is also a form 200 that is die-cut from beverage board, though other materials may also be used as will occur to those skilled in the art. Form 200 is similar to form 100, except for the differences below. Moreover, while FIG. 2 shows one side (e.g., a front) of flat 200, it will be understood that the opposing (e.g., rear) side is essentially a mirror image of the view shown in FIG. 2.

Form 200 includes front panel 210, back panel 220, side panels 230, 235, bottom panels 240, 245, and tab 270 that collectively define a container portion 248. In the embodiment shown, panels 210, 220, 230, 235 define a top edge extending along a line 249. Form 200 also includes risers 250*a*, 250*b* and handle flaps 260*a*, 260*b* extending substantially from line 249 away from top edge, that define a handle portion 258. As shown, handle flap 260*a* and riser 250*a* extend from panel 230 such that a portion of flap 260*a* is outboard of panel 230 and flap 270. Handle flap 260*b* extends from panels 235, 210, and riser 250*b* extends from panel 235.

As form 200 goes through the die-cutting process, handle edge segments 280*a*, 280*b* are also cut, separating handle flap 260*a* from panel 230, and separating handle flap 260*b* from panels 235, 210. In the embodiment shown, fold lines 290 are scored, perforated, or otherwise treated or configured to facilitate later handling or assembly of the form 200 during the die cutting process. However, in other embodiments, one or both of fold lines 290 do not include such features, so fold lines 290 represent imaginary lines along which flaps 260*a*, 260*b* may be folded relative to risers 250*a*, 250*b*. Moreover, in other embodiments, segments 280*a*, 280*b* and fold lines 290 may be treated before or after form 200 is created through a die cutting process. In the embodiment shown, handle flaps 260*a*, 260*b* each include carrying holes 265 that are cut out from handle flaps 260*a*, 260*b*. As shown in the present embodiment, holes 265 are sized and configured to receive at least one finger of a person carrying the carrier in the assembled configuration. In the embodiment illustrated in FIG. 2, holes 265 include an obround shape, but in other embodiments may include any other suitable shape as will occur to persons skilled in the art in view of the teachings herein.

In alternative embodiments, portions of handle portion 258 may extend below line 249. For example, segments 280*a*, 280*b* may extend below line 249, thus causing portions of handle flaps 260*a*, 260*b* to lie below line 249. It will be understood that in some embodiments, after form 200 is formed into the assembled configuration, some portions of handle portion 258, such as portions of handle flaps 260*a*, 260*b*, may lie below line 249, due to manufacturing or assembly related anomalies or inconsistencies.

Container portion 248 comprises a plurality of fold lines 26, 28, 30, 32, 34, 36, 38, 40 along which portions of form 200 may be folded in order to form the assembled configuration of form 200. As shown, fold line 26 extends between panels 220, 235, while fold line 28 extends between panels 235, 210. Fold line 30 extends between panels 210, 230, and fold line 32 extends between panel 230 and flap 270. Fold line 32 extends between panel 230 and the adjacent bottom panel 240, while fold line 36 extends between panel 210 and the adjacent bottom panel 245. Fold line 38 extends between panel 235 and the adjacent bottom panel 240, and fold line 40 extends between panel 220 and the adjacent bottom panel 245. Fold lines 290 extend between handle flap 260*a*, 260*b* and riser 250*a*, 250*b*. In the embodiment shown, fold lines 26, 28, 30, 32, 190 are parallel to one another and perpendicular to fold lines 34, 36, 38, 40. As shown, fold lines 34, 36, 38, 40 are collinear when form 200 is unassembled. In the embodiment shown, fold lines 26, 28, 30, 32, 34, 36, 38, 40 represent imaginary lines along which form 200 may be folded to form the carrier. However, in some embodiments, any or all of fold lines 26, 28, 30, 32, 34, 36, 38, 40 may be scored, perforated, or otherwise treated or configured in a manner that facilitates later handling or assembly of the form 200.

After form 200 is cut, it is passed through forming equipment as is known by those skilled in the art. In this case, panels 230, 210, 235, and 220 are folded at approximately 90-degree angles with each other to form a rectangle, in cross section, such as in cross section along line 249 (e.g., block 302 of FIG. 6). Tab 270 is likewise folded to be inside side panel 220 such that it is glued to the back of panel 220 (e.g., block 304 of FIG. 6). Accordingly, a bonding or non-bonding attachment (as will occur to those skilled in the art) is provided between tab 270 and panel 220 along a third plane that is substantially perpendicular to line 249 and parallel to a second plane (block 306 of FIG. 6).

In order to form the bottom portion of the expanded carrier configuration of form 100, bottom panels 240 and 245 are folded up along their respective fold lines 34, 36, 38, 40 and glued together. In the embodiment shown, in the assembled configuration, bottom panels 240, 245 lie substantially perpendicularly to each of the panels 210, 220, 230, 235. Thus, in the embodiment shown, panels 210, 220, 230, 235, 240, 245 in the assembled configuration define a single compartment extending substantially from bottom panels 240, 245 to line 249 (block 302 of FIG. 6). More particularly, panels 210, 220, 230, 235 define sidewalls of a compartment while bottom panels 240, 245 collectively define a bottom portion or bottom wall of a compartment.

Handle flaps 260*a*, 260*b* are folded at fold lines 290 so that they extend perpendicular to risers 250*a*, 250*b*, and parallel to front and rear panels 210, 220 (blocks 308, 310 of FIG. 6). The rear portions of each of handle flaps 260*a*, 260*b* are glued together such that each of the holes 265 is aligned with the other to form a single opening in handle portion 258, and such that flaps 260*a*, 260*b* lie substantially along a second plane in order to form a unitary handle of handle portion 258 (blocks 312, 314 of FIG. 6). In the embodiment shown, the second plane essentially bisects container portion 248 such that handle of handle portion 258 lies at the midpoint between panels 210, 220. Thus, in the embodiment shown, handle portion 258 essentially defines two cells above line 249 that are each suitable for holding two bottles. Accordingly, while container portion 248 defines a single compartment as described above, handle portion 258 allows for an effective separation of bottles or other articles that may be placed in the compartment of container portion 248.

In some implementations, before or after form 200 is cut out, form 200 may be passed through a digital printer that selectively applies text and/or graphics to one or both sides of the form 200. In some of these implementations, the text and/or graphics are customized by a third-party, automatically computer-generated per a remote customer's request, programmatically and even uniquely generated, or otherwise designed to take advantage of short-run capabilities. Due to the configuration of form 200 as described herein, text and graphics need only be applied to one side of form 200 in its flattened configuration in order to display such text and/or graphics on the front or outer portion of form 200 in its expanded, carrier configuration.

Figure 3:
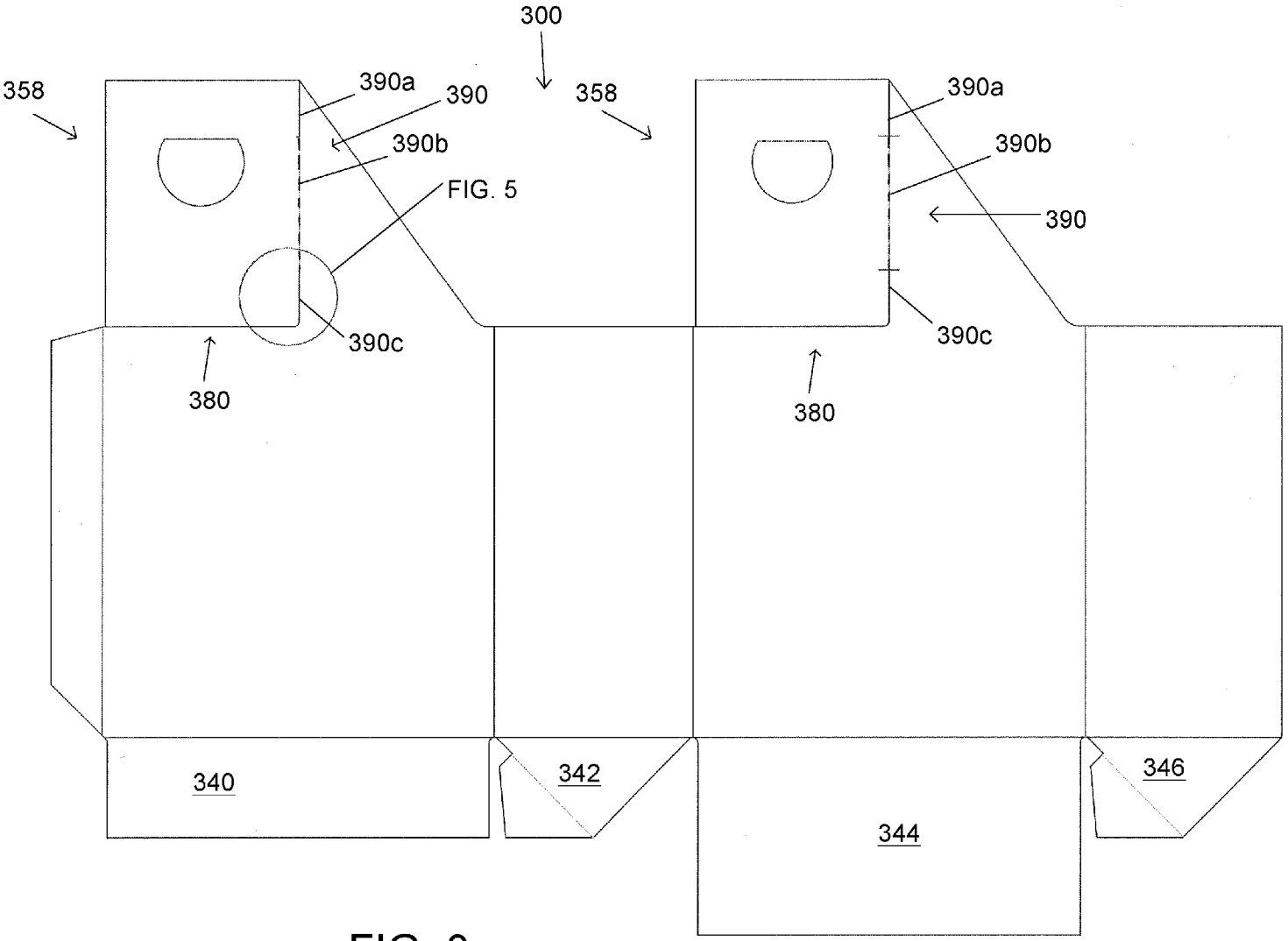
FIG. 3 is a plan view of a flat that may be formed into a carrier according to a third embodiment.

FIG. 3 shows another embodiment of a form 300 that may be constructed or formed into an assembled configuration to make a carrier. Form 300 is substantially similar to form 100, discussed above with reference to FIG. 1, except for the differences below. For that reason, substantially similar or identical structures are not labeled with reference numerals. As shown, form 300 includes exemplary alternative bottom panels 340, 342, 344, 346 that are configured differently than bottom panels 140, 145. As shown, panels 340, 344 include a substantially rectangular shape. Panels 342, 346 include features that allow those panels to lock together as bottom panels 340, 342, 344, and 346 are folded upwardly to form a bottom of carrier. As shown, panel 344 includes dimensions that allow it to substantially cover the surface area of the bottom portion of carrier in the expanded configuration. For example, panel 344 has substantially the same width as panel 110 and a height that substantially matches the width of panel 130 so that panel 344 substantially covers the bottom of the container portion of the carrier when it is assembled. Other suitable configurations (including relative size, shape, and other features) of bottom panels 340, 342, 344, 346 will be apparent to persons skilled in the art in view of the teachings herein.

Form 300 includes an exemplary alternative handle portion 358. Particularly, handle portion 358 includes an alternative segment (cut) 380 that includes a substantially straight, horizontal portion 380*a* and a curved portion 380*b*, as seen best in FIG. 5. Thus, segment is cut along horizontal portion 380*a* and curved portion 380*b*. Including the curved portion 380*b* in segment 380 may decrease the tendency of handle portion 358 to tear at the junction between the risers 150 and adjoining panels 110, 120, respectively. Form 300 also includes an alternative fold line 390. Fold line 390 comprises an upper portion 390*a*, middle portion 390*b*, and lower portion 390*c*. As shown, middle portion 390*b* is scored, perforated, or otherwise treated or configured in a manner that facilitates later handling or assembly of the form 300, such as folding of the handle flaps 160. As shown, upper and lower portions 390*a*, 390*c* represent imaginary lines along which form 100 may be folded to form the carrier. However, in other embodiments, upper and lower portions 390*a*, 390*c* may be scored, perforated, or otherwise treated or configured in a manner that facilitates later handling or assembly of the form 300. In some embodiments, such a configuration may give additional strength to handle portion 358. For example, such a configuration may decrease the tendency of handle portion 358 to tear at the junction between the risers 150 and adjoining panels 110, 120, respectively. Other suitable configurations of handle portion 358 will be apparent to persons skilled in the art in view of the teachings herein.

Figure 4:
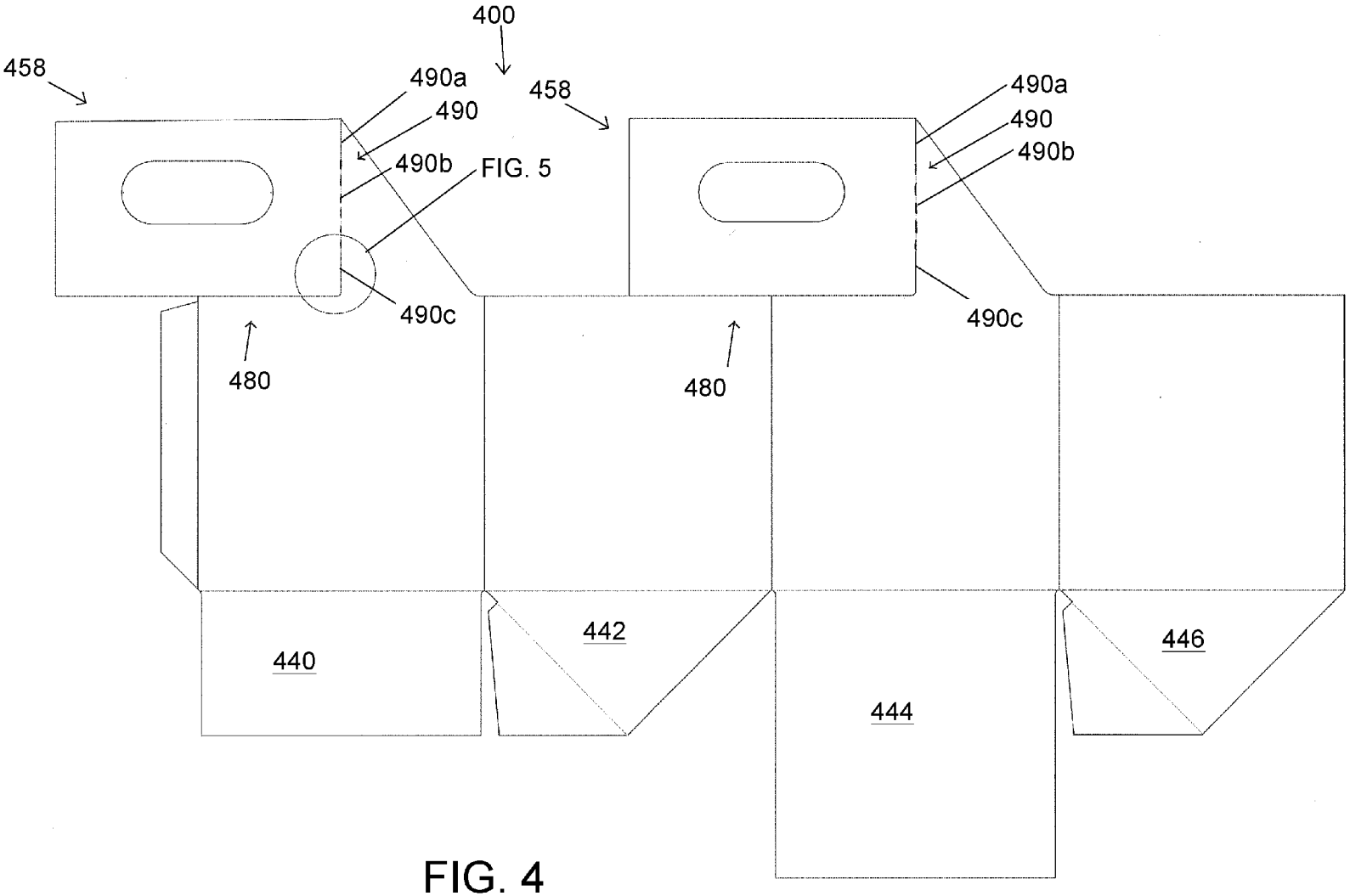
FIG. 4 is a plan view of a flat that may be formed into a carrier according to a fourth embodiment.

FIG. 4 shows another embodiment of a form 400 that may be constructed or formed into an assembled configuration to make a carrier. Form 400 is substantially similar to form 200, except for the differences below. For that reason, substantially similar or identical structures are not labeled with reference numerals. As shown, form 400 includes exemplary alternative bottom panels 440, 442, 444, 446 that are configured differently from bottom panels 240, 245. Panels 442, 446 include features that allow those panels to lock together or be attached more securely to bottom panels 440, 444 as bottom panels 440, 442, 444, and 446 are folded upwardly to form a bottom of carrier. As shown, panel 444 includes dimensions that allow it to substantially cover the surface area of the bottom portion of carrier in the expanded configuration. For example, panel 444 has substantially the same width as panel 235 and a height that substantially matches the width of panel 210. Other suitable configurations of bottom panels 440, 442, 444, 446 will be apparent to persons skilled in the art in view of the teachings herein.

Figure 5:
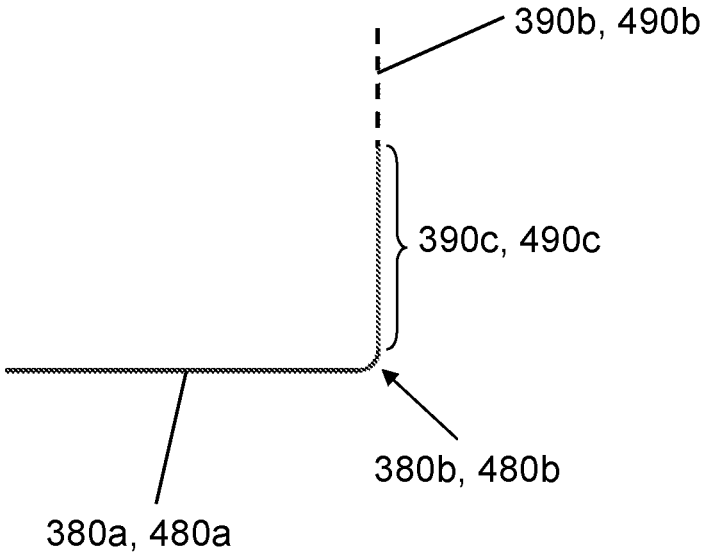
FIG. 5 is an expanded plan view of a detail of the flat of FIG. 4.

Form 400 includes an exemplary alternative handle portion 458. Particularly, handle portion 458 includes an alternative segment 480 that includes a horizontal portion 480*a* and a curved portion 480*b*, as seen best in FIG. 5. It will be understood that although segments 380, 480 and fold lines 390, 490 are different, respectively, the portions shown in the close-up view of FIG. 5 are substantially identical. Thus, FIG. 5 is used to demonstrate and show such structures of form 400 as well.

As shown, segment 480 is cut along horizontal portion 480*a* and curved portion 480*b*. Including the radius of curved portion in segment 480 may decrease the tendency of handle portion 458 to tear at the junction between the risers 250*a*, 250*b* and adjoining panels 230 and 210, 235, respectively. Form 400 also includes an alternative fold line 490. Fold line 490 comprises an upper portion 490*a*, middle portion 490*b*, and lower portion 490*c*. As shown, middle portion 490*b* is scored, perforated, or otherwise treated or configured in a manner that facilitates later handling or assembly of the form 400, such as folding of the handle flaps 260*a*, 260*b*. As shown, upper and lower portions 490*a*, 490*c* represent imaginary lines along which form 100 may be folded to form the carrier. However, in other embodiments, upper and lower portions 490*a*, 490*c* may be scored, perforated, or otherwise treated or configured in a manner that facilitates later handling or assembly of the form 400. Such a configuration may provide for additional strength of handle portion 458. For example, such a configuration may decrease the tendency of handle portion 458 to tear at the junction between the risers 150 and adjoining panels 110, 120, respectively. Other suitable configurations of handle portion 458 will be apparent to persons skilled in the art in view of the teachings herein.

All publications, prior applications, and other documents cited herein are hereby incorporated by reference in their entirety as if each had been individually incorporated by reference and fully set forth. While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A unitary flat for forming a carrier to hold and carry a plurality of bottles, the flat comprising:

a side portion having an upper edge and a lower edge, the upper edge and lower edge being opposite each other;

a first end and a second end, the second end being opposite the first end; and a tab portion extending from the first end;

a plurality of handle portions, each of the handle portions comprising:

an extension portion that extends from the upper edge of the side portion; and a cross portion that extends the extension portion, but is otherwise detached from the side portion; and one or more flaps extending from the lower edge of the side portion, wherein at least one of the plurality of handle portions extends beyond an end of the side portion in the direction of the upper edge.

2. The unitary flat of claim 1, wherein:

the side portion is scored to define a first side panel, a second side panel, a third side panel, and a fourth side panel, each side panel extending from the upper side to the lower side;

the first side panel and the third side panel are substantially the same width when measured parallel to the lower side, and the second side panel and the fourth side panel are substantially the same width when measured parallel to the lower edge of the side portion.

3. The unitary flat of claim 1, wherein the upper edge and the lower edge are substantially parallel.

4. The unitary flat of claim 1, wherein a cut separates the cross portion from the side portion, the cut has a substantially straight portion and a curved portion, and the curved portion extends from the end of the substantially straight portion of the cut away from the side portion of the flat.

5. A unitary flat for forming a carrier configured to hold bottles, the flat comprising:

(a) a container portion, comprising:

(i) a first side panel, (ii) a front panel, (iii) a second side panel, (iv) a rear panel, wherein the first side panel, the front panel, the second side panel, and the rear panel define a top edge, and (v) at least one bottom panel, wherein the first side panel, the front panel, the second side panel, the rear panel, and the at least one bottom panel are foldable relative to one another to form a generally rectangular shape; and (b) a handle portion, comprising:

(i) a first handle portion extending from one of the first side panel, the front panel, the second side panel, and the rear panel, wherein the first handle portion extends from the top edge, wherein the first handle portion comprises a first handle flap, wherein the first handle flap is disconnected from the container portion, wherein the first handle flap is foldable relative to the rest of the first handle portion along a first fold line that is perpendicular to the top edge, and (b) a second handle portion extending from another one of the first side panel, front panel, second side panel, and rear panel, wherein the second handle portion extends from the top edge, wherein the second handle portion comprises a second handle flap, wherein the second handle flap is disconnected from the container portion, wherein the second handle flap is foldable relative to the rest of the second handle portion along a second fold line that is perpendicular to the top edge and parallel to the first fold line, and wherein a portion of the second handle portion extends beyond an end of the container portion in the direction of the top edge.

6. The flat of claim 5, wherein the at least one bottom panel comprises four bottom panels, where each of the first side panel, the front panel, the second side panel, and the rear panel has one of the plurality of bottom panels extending therefrom.

7. The flat of claim 6, wherein each of the bottom panels is foldable along an axis that is parallel to the top edge.

8. The flat of claim 5, wherein the first handle portion is coincident with only one of the first side panel, the front panel, the second side panel, and the rear panel, wherein the second handle portion is coincident with only one of the first side panel, the front panel, the second side panel, and the rear panel.

9. The flat of claim 8, wherein one of the first and second handle portions extends from the first side panel, wherein the other of the first and second handle portions extends from the second side panel.

10. The flat of claim 5, wherein the first handle portion further comprises a first riser member having the first handle flap extending therefrom, and the first handle flap is not connected to the container portion;

the first fold line is between the first handle flap and the first riser;

the second handle portion further comprises a second riser member having the second handle flap extending therefrom, and the second handle flap is not connected to the container portion; and the second fold line is between the second handle flap and the second riser.

11. The flat of claim 10, wherein each of the first and second risers has a generally triangular configuration.

12. The flat of claim 5, wherein at least one of the first and second fold lines comprises a weakened portion.

13. The flat of claim 5, wherein a cut or scoring between the first handle flap and the container portion comprises a substantially straight portion and a curved portion that extends the cut or scoring from the end of the substantially straight portion in a direction away from the container portion.

14. A method of forming a flat into a carrier configured to hold bottles, wherein the flat comprises a first side panel, a front panel, a second side panel, and a rear panel, wherein the first side panel, the front panel, the second side panel, and the rear panel define a top edge; a bottom panel; a first handle portion extending from one of the first side panel, the front panel, the second side panel, and the rear panel; and a second handle portion extending from another one of the first side panel, the front panel, the second side panel, and the rear panel; and wherein the flat is a single layer of material; the method comprising:

(a) from a flat configuration wherein the first handle portion extends beyond an end of the first side panel, the front panel, the second side panel, and the rear panel in the direction of the top edge, folding the first side panel, the front panel, the second side panel, the rear panel, and the bottom panel relative to one another to form a generally rectangular shape;

(b) folding a first flap portion of the first handle portion along a first fold line such that the first flap portion is positioned generally perpendicular to another portion of the first handle portion;

(c) folding a second flap portion of the second handle portion along a second fold line such that the second flap portion is positioned generally perpendicular to another portion of the second handle portion; and (d) attaching the first and second flap portions to form a handle; wherein the first side panel, the front panel, the second side panel, the rear panel, and the bottom panel define a single compartment below the handle.

15. The method of claim 14, wherein the handle extends along a second plane, and the second plane is perpendicular to the front and rear panels.

16. The method of claim 15, wherein the flat further comprises a flap extending from one of the first side panel, the front panel, the second side panel, and the rear panel in the direction parallel to the top edge, the method further comprising:

coupling the flap to another one of the first side panel, the front panel, the second side panel, and the rear panel.

17. The method of claim 14, further comprising before the folding steps, printing on one side of the flat with a digital printer.

18. The method of claim 17, wherein the printing includes information unique to the particular flat.

* * * * *